United States Patent [19]

Harrigan

[11] 4,082,090

[45] Apr. 4, 1978

[54] MECHANICAL CARDIAC RESUSCITATOR

[76] Inventor: Roy Major Harrigan, Bromley Mountain Rd., Manchester, Vt. 05254

[21] Appl. No.: 762,499

[22] Filed: Jan. 26, 1977

[51] Int. Cl.[2] ..... A61H 7/00

[52] U.S. Cl. ..... 128/51; 128/28

[58] Field of Search ..... 128/51–55, 128/28, 2.05 R

[56] References Cited

U.S. PATENT DOCUMENTS

| | | | |
|---|---|---|---|
| 3,610,233 | 10/1971 | Barkalow | 128/53 |
| 3,782,371 | 1/1974 | Derovineau | 128/28 |
| 3,896,797 | 5/1975 | Bucur | 128/53 |

*Primary Examiner*—Lawrence W. Trapp
*Attorney, Agent, or Firm*—Robert S. Smith

[57] ABSTRACT

A mechanical cardiac resuscitator which applies rhythmic pressure to a patient's chest in order to restore heart beat is provided with a control which may sound an alarm or turn off the resuscitator if the point of impact on the patient deviates from a predetermined area. In one form a conductive sheet disposed on the patient cooperates with electric contacts disposed on the plunger of the resuscitator.

10 Claims, 2 Drawing Figures

MECHANICAL CARDIAC RESUSCITATOR

BACKGROUND OF THE INVENTION

The invention relates generally to medical apparatus and particularly to apparatus for mechanically applying rhythmic pressure to a patient's chest in order to maintain artificial circulation. The mechanical apparatus provided to maintain the circulation of a person whose heart has stopped beating are driven ordinarily by electric motors, compressed air, gas and in some cases manually. Such apparatus ordinarily provides a generally planar horizontal surface on which the patent is strapped underneath a plunger which depresses the sternum in the center of his chest 1½ to 2 inches at a regular rate.

A serious problem exists with respect to such apparatus in that improper positioning of the patient in the device or slippage after initial positioning of the patient such as may readily occur when the patient is being moved on a stretcher with the apparatus attached or when the apparatus is used in a moving ambulance. In extreme cases the ambulance may traverse a bumpy road or even have an accident resulting in movement of the patient. This movement of the patient will result in substantial pressure being applied to portions of the patient's chest other than the lower sternum and in some cases has caused great damage such as broken ribs, punctured lungs, heart and throat injuries, etc., in addition to interrupting the process of cardiac resuscitation and the creation of artificial circulation. The interruption aspect may be potentially even more dangerous than the other injuries. The problem is compounded in that usually the attendants who are operating the machine are extremely busy tending to various other problems with the patient or with other patients and may not recognize the existence of the problem for a finite time interval which is longer than the time in which substantial injury to the patient may occur.

It is an object of the invention to provide apparatus which will enable the operator to quickly and easily define a predetermined region on a patient over which the plunger will apply a force.

It is another object of the invention to provide apparatus which will either turn the resuscitator off or sound an alarm or both.

It is still another object of the invention to provide apparatus which is simple and inexpensive to manufacture and use.

SUMMARY OF THE INVENTION

It has now been found that these and other objects of the invention may be satisfied by apparatus for mechanical resuscitation which includes a reciprocating plunger, means for driving the plunger between upward and downward positions, means for defining a predetermined region of an associated human torso to which a cyclical force is to be applied, and means for controlling the resuscitator responsive to impact of the plunger on the predetermined area or lack of impact on the predetermined area to vary the control of the resuscitator.

In one form the means for controlling will turn off the means for driving. In other forms the means for controlling may (1) only sound an alarm or (2) off the means for driving and sound an alarm.

In some forms the predetermined region will be defined by a sheet of conductive material and the plunger will have at least one electrical contact for cooperation with the sheet during at least a part of the movement thereof.

DESCRIPTION OF THE PREFERRED EMBODIMENT

Figure 1:
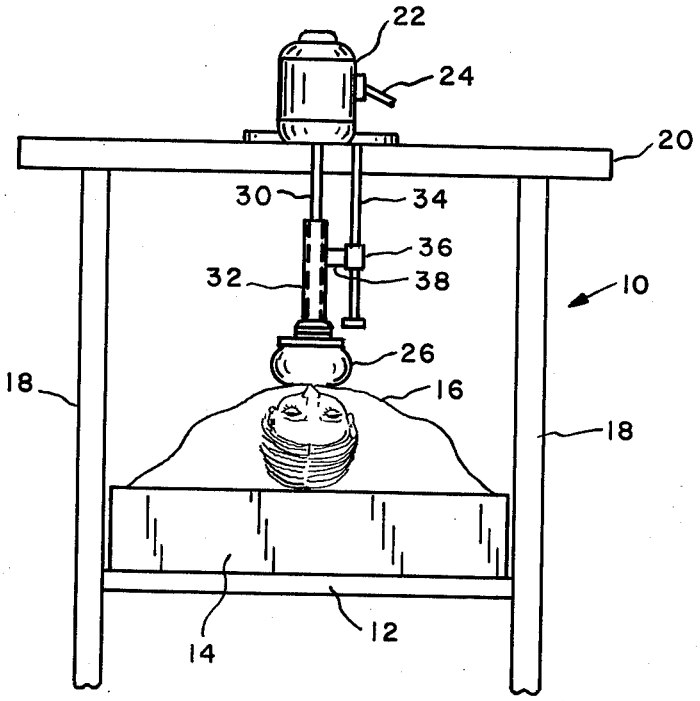
FIG. 1 is an elevational view of a cardiac resuscitator apparatus in accordance with one form of the invention.

Referring now to FIG. 1 there is shown a resuscitator 10 which includes supports 12 (one shown) which carry a mattress 14 on which is disposed a patient 16. Extending from the supports 12 are uprights 18 which carry a cross-beam 20 on which is mounted an electric motor 22 having wires 24 extending therefrom for connection to an external power source.

Although the manner of driving the plunger 26 between upward and downward positions will vary, the embodiment shown utilizes a depending rod 30 which has camming grooves (not shown) which extend in a generally helical fashion about the rod 30 and which cooperate with sleeve 32 to drive the plunger 26 between upward and downward positions. A stationary depending rod 34 is provided to cooperate with sleeve 36 which slides thereon and which is fixedly attached by member 38 to sleeve 32. The function of members 34, 36 and 38 is to prevent rotation of sleeve 32. Other electric motor drive versions will utilize a crank arm with an eccentric drive member. Other constructions are either known in the art or apparent to those skilled in the art. The invention has application not only to the mechanical arrangement shown in FIG. 1 but to the other mechanical arrangements which are either known or obvious.

Figure 2:
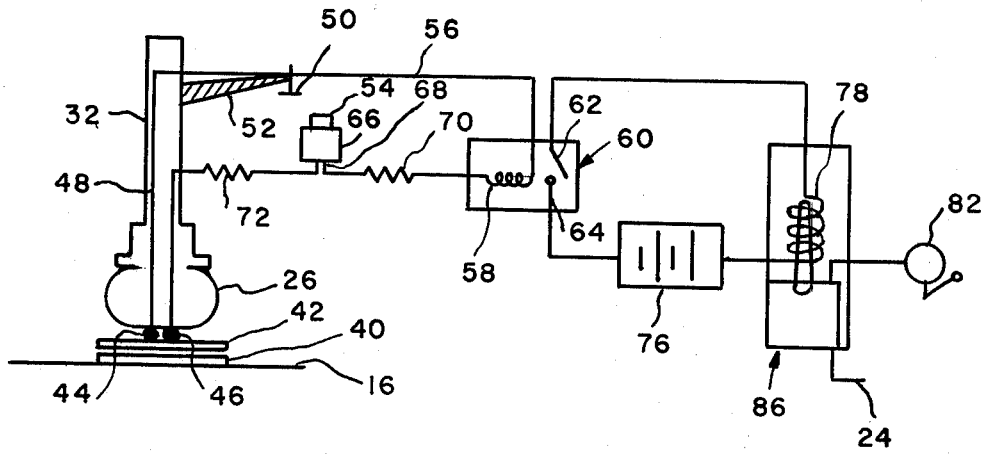
FIG. 2 is a diagrammatic view showing the controls for the apparatus shown in FIG. 1.

Referring now to FIG. 2 there is shown a diagram of the control circuit for the apparatus in accordance with the invention. FIG. 2 shows the sternum of the patient 16 and the plunger 26 which is fixedly attached to sleeve 32 which are all shown in FIG. 1. In the embodiment shown a layer of adhesive material 40 is provided for fixing a sheet of conductive material 42 to the sternum. The plunger 26 is provided with electrical contacts 44 and 46 which have been exaggerated in the vertical dimension to make them more visible. The contacts 44, 46 in the downward position of the plunger 26 make contact with the conductive sheet 42. Ordinarily the conductive sheet 42 will be approximately three inches by one inch. Wire 48 extends from contact 44 to a contact 50 which is carried on arm 52 fixedly attached to sleeve 32. A contact 54 cooperates with contact 50 and the mountings therefore whereby continuity is established between contacts 50 and 54 when the plunger 26 is at the full downward position. Ordinarily the phased relationship between the contacts 50 and 54 and the cooperation between the contacts 44 and 46 and sheet 42 should be such that the contacts 50 and 54 never complete continuity before the plunger 26 is in the full downward position. As it will be seen hereafter, premature closing of the contacts 50, 54 would result in a false alarm or resuscitator shutdown or both. A wire 56 extends from the contact 50 to the coil of a latching relay assembly 60 having a movable contact 62 and a stationary contact 64. A source of power 66 is connected between contact 54 and terminal 68. Resistor 70 is connected between the coil 58 and the terminal 68. A second resistor 72 is connected in series between terminal 68 and contact 46.

Connected to the movable contact 62 and the stationary contact 64 is a battery 76 and the coil 78 of a relay 80. The relay when energized interrupts power on conductor 24 which supplies power to the motor 22 shown in FIG. 1. In the embodiment shown operation of the relay by application of power to the coil 78 also supplies power to an audible alarm or bell 82.

In operation as the plunger 26 reaches its full down position in correct alignment with the predetermined area defined by the conductive sheet 42, contacts 44 and 46 make electrical contact with the sheet 42. Immediately thereafter contacts 50 and 54 close. The sizing of resistor 72 as compared to the sizing of resistor 70 results in substantially all the current flow from the power source 66 flowing through resistor 72, contact 46, sheet 42, contact 44, wire 48 and contacts 50, 54. Because of the sizing of resistor 72 with respect to the sizing of resistor 70 there will be insufficient current flow through conductor 56 coil 58 and resistor 70 to close latching relay 60.

If at the end of the downward stroke of the plunger 26 there is misalignment between the plunger 26 and the conductive sheet 42 such that one or both of the contacts 44 do not contact the conductive sheet 42, the closing of contacts 50 and 54 which is phased with respect to the downward position of the plunger 26 will cause current flow from power source 66 to flow through contacts 54, 50, wire 56, coil 58, resistor 70 and terminal 68 to cause the movable contact of relay 60 to close against stationary contact 64. In its preferred form the relay 60 will be latching, i.e., once the solenoid coil is energized a permanent will hold the mobile contact 60 in engagement with the stationary contact 64 until the relay 60 is manually reset.

The closing of contacts 62 and 64 causes power from battery 76 to flow through coil 78 of relay assembly 80 which in one form of the invention will sound the alarm 82 and interrupt power to the motor 22.

Although the apparatus in accordance with the invention has been shown and described in terms of electrical means for accomplishing the desired function, it will be understood that equivalent pneumatic, magnetic, optical or other structures are contemplated by the invention. In pneumatic embodiments a flexible chamber or bag may be positioned on the predetermined area which contains a gas under pressure. Variation in pressure in the bag as a result of impact by the plunger may be used to operate a pressure switch. Similarly in completely pneumatic apparatus the gas pressure may operate a diaphragm valve to control the flow of air pressure to the drive for the plunger. Similarly, audible alarms are well known which are operated by pneumatic pressure such as whistles. A magnetic equivalent includes adhesive tape having a ferrous surface thereon to define the predetermined area for the plunger to impact and a magnetic sensor such a magnetic reed switch disposed at the lowermost extremity of the plunger so that if the low point of the plunger cycle does not result in a magnetic sensing of the ferrous surface the machine will stop and an alarm will sound. An optical embodiment utilizes a shiny surface sensor and an optical reflection to a photocell. The absence of a reflection to the photocell would interrupt operation of the apparatus. Numerous other equivalent other structures will be apparent to those skilled in the art.

It will be understood that the apparatus described will provide a simple and positive apparatus to insure the resuscitation technique is not interrupted without a positive alarm being given to the operator and further avoids the possibility that patient is injured by the plunger which is applying the force. The significant medical advantages are apparent.

Having thus described my invention I claim:

1. Apparatus for mechanical resuscitation which comprises:

a plunger, means for driving said plunger between upward and downward positions, means for defining a predetermined region of an associated human torso to which a cyclical force is to be applied, and means for controlling said resuscitation apparatus responsive to impact of said plunger on said predetermined area or the lack of impact on said predetermined area.

2. The apparatus as described in claim 1 wherein said means for controlling turns said means for driving off when said plunger does not impact on said predetermined region when said plunger is at the extreme downward position and does not contact said means for defining a predetermined region.

3. The apparatus as described in claim 1 further including an audible alarm and wherein said for controlling turns said audible alarm on which said plunger is at the extreme downward position and not contacting said means for defining a predetermined region.

4. The apparatus as described in claim 1 where said means for defining a predetermined region is a sheet of conductive material.

5. The apparatus as described in claim 4 wherein said conductive layer has adhesive on one side thereof whereby said conductive layer is affixed to the associated torso.

6. The apparatus as described in claim 4 wherein said plunger has at least one electrical contact for cooperation with said sheet during at least a part of the movement thereof.

7. The apparatus as described in claim 6 wherein said plunger further includes a second contact for cooperation with said conductive sheet during at least a part of the movement of said plunger.

8. The apparatus as described in claim 7 wherein said means for controlling includes a relay having a normally open contact.

9. The apparatus as described in claim 8 wherein said means for controlling further includes a source of power for operating said relay and switching means connected to said two contacts to close said relay when said plunger is at the extreme downward point of the travel thereof and not contacting said conductive sheet.

10. The apparatus as described in claim 6 wherein said switching means includes a switch connected to one of said contacts and means for closing said switch when said plunger is in the extreme downward position.

* * * * *